United States Patent [19]

Murphy

[11] 4,241,846

[45] Dec. 30, 1980

[54] GARBAGE CAN COVER RETAINER

[76] Inventor: William Murphy, DaCola Shores, Conesus, N.Y. 14435

[21] Appl. No.: 951,643

[22] Filed: Oct. 16, 1978

[51] Int. Cl.[3] ..... B65D 45/08

[52] U.S. Cl. ..... 220/318; 292/258; 292/288

[58] Field of Search ..... 220/318; 292/258, 288

[56] References Cited

U.S. PATENT DOCUMENTS

| | | | |
|---|---|---|---|
| 2,998,276 | 8/1961 | Shettler | 292/288 |
| 3,011,818 | 12/1961 | Matthiessen | 292/288 |
| 3,291,515 | 12/1966 | Lierman | 220/318 |
| 3,859,760 | 6/1971 | Williams | 292/258 |

OTHER PUBLICATIONS

*What's New . . . for Your Car,* Popular Science, Oct. 1962, p. 168.

*Primary Examiner*—George E. Lowrance
*Attorney, Agent, or Firm*—Raymond F. Kramer

[57] ABSTRACT

A retainer for holding a cover onto a garbage can includes readily disconnectable holding means suitable for holding onto a garbage can handle, a spring joined to the holding means, a chain joined to the spring and holding means for passing through the other garbage can handle, after the retainer has been passed through the cover handle, and for holding onto the chain at a desired position so as to adjust the length of the retainer and the force by which it holds the cover to the garbage can. The spring means, in its normally most extended use position, is positioned below the top of the garbage can cover so that it remains unbent in use.

8 Claims, 2 Drawing Figures

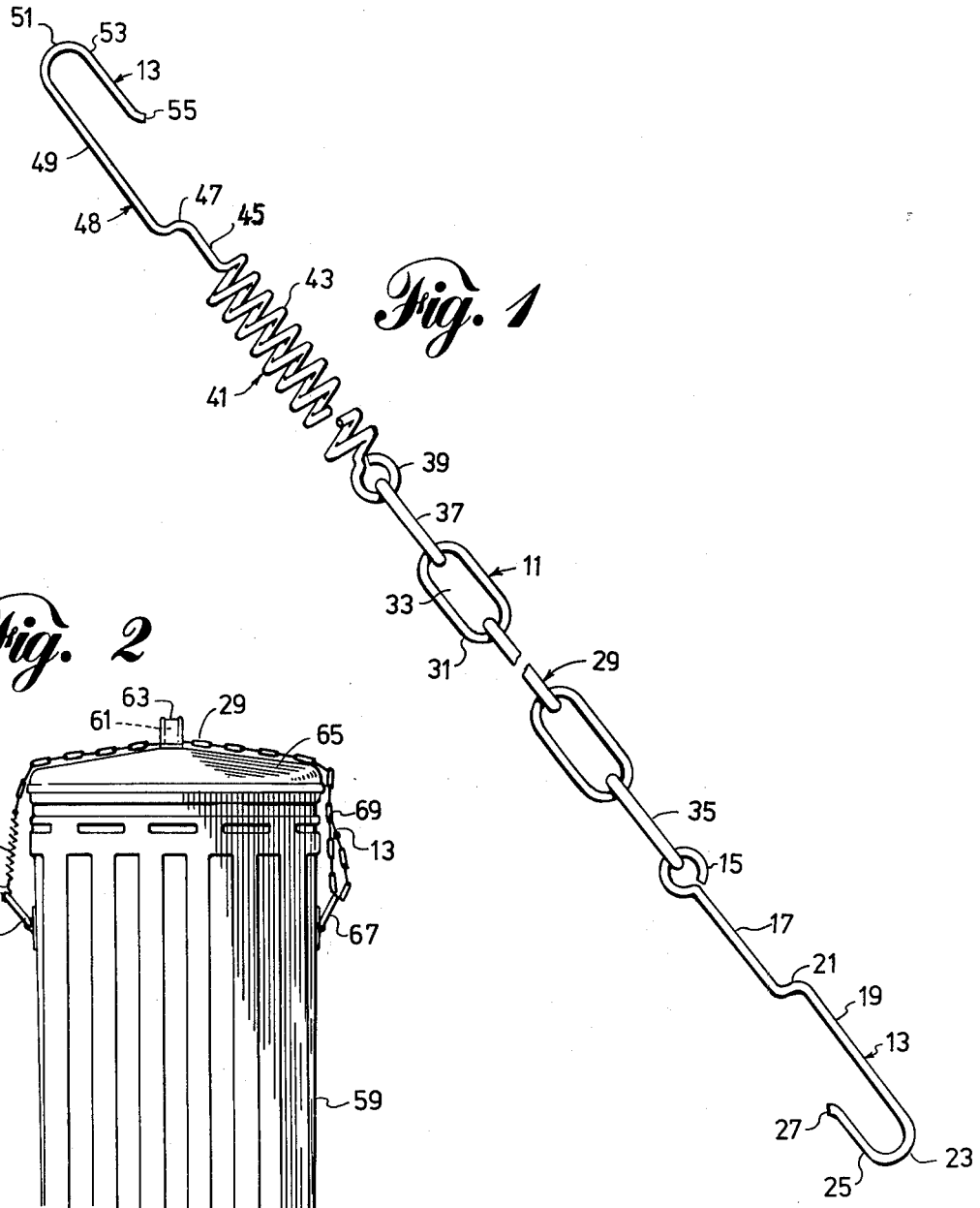
Fig. 1
Fig. 2
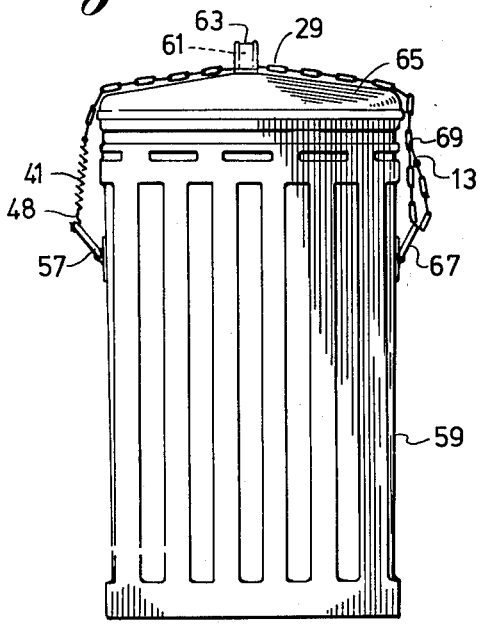

GARBAGE CAN COVER RETAINER

This invention relates to a retainer for holding a cover onto a garbage can. More particularly, it relates to a retainer which passes through a hangle on a garbage can cover and is readily disconnectably fastenable to the garbage can handles in such manner as to permit ready adjustment of the retainer length and modification of the force by which it holds the cover to the garbage can.

The problem of retaining covers on garbage cans is an old one and various solutions have been suggested. Among the crudest of these is the placement of weights, such as stones, on the cover but such is often unsatisfactory because animals seeking to obtain access to the contents of the can can push the stones off or can overturn the can and then work the cover loose, if it had not already become released when the can fell. More positive holding devices have been employed, including tying and similar means for holding the cover onto the can by fastening to the can handles and passing over the cover and through the handle thereon. Although some of these have been well-designed they have not been as satisfactory as the present invention in positively, yet readily releasably holding the cover in place.

In accordance with the present invention a retainer for holding a cover having a central handle thereon in covering position on a two-handle garbage can on which the handles are on opposite sides and near the top, comprises a readily disconnectable first holding means, a plurality of connected links connected to said holding means and forming a chanin extending from it, a spring means connected to such chain away from the first holding means and a second holding means connected to the spring means and adapted for holding onto a handle of the garbage can, said retainer being passable through the cover handle and said first holding means and said chain being passable through a garbage can handle so that the first holding means may be held to the chain to adjust the length of the retainer and the force by which it holds the cover to the garbage can. The spring means, in its normally most extended use position, is positioned below the top of the garbage can cover so that it remains unbent in use. This invention also relates to a covered garbage can with a cover being retained firmly in position thereon which comprises a garbage can having a pair of handles on opposite sides near the top thereof, a cover having a substantially centrally located handle on the top thereof, which cover is in position covering the garbage can, with the handle opening thereof being coaxial with a vertical plane passing through the middles of the can handles, and a retainer for holding the cover in position on the garbage can, which retainer includes a readily disconnectable first holding means, a plurality of connected links connected to said holding means and forming a chain extending from it, a spring means connected to such chain away from the first holding means and a readily disconnectable second holding means connected to the spring means and adapted for holding onto a handle of the garbage can, said retainer being passed through the cover handle, said second holding means holding onto the garbage can handle, said chain being passed through and around the other garbage can handle and the first holding means holding to the chain to hold the cover in place on the garbage can with desired force. The spring, even when extended, will be below the bottom edge of the can cover, so that when the retainer is installed the spring will not be bent.

A search for relevant prior art has resulted in the finding of U.S. Pat. Nos. 2,998,276; 3,124,381; 3,174,787; 3,363,924; 3,503,535; 3,589,760; 3,674,298; and 4,009,879. Although such patents describe various solutions to the problem of holding a garbage can cover firmly in place during the period when it is standing by the curb awaiting collection, none describes the combined features of the present invention and none shows or suggests such an invention, which is readily installed and removed, useful for differently sized garbage cans, capable of easily modifying the force by which the cover is held to the can, readily manufacturable from available materials and inexpensive and almost indestructible in hard use.

The invention will be readily understood and its significant advantages over the prior art devices will be readily appreciated by reference to the present description, taken in conjunction with the drawing, in which:

FIG. 1 is a partial perspective view of the retainer of this invention, with chain and spring portions thereof shortened to facilitate illustration; and FIG. 2 is a reduced scale perspective of the FIG. 1 retainer in position holding a cover to a garbage can, with the spring being shown in tension, exerting a holding force on the cover.

In FIG. 1 retainer 11 includes first holding means or hook 13 having an eye or fastening portion 15, a stem or shaft portion 17, an offset shank portion 19, connected by offsetting bend 21 to shaft 17, a bend 23 in the form of a U and a hooking portion 25, bent back in the general direction of shaft 17 and shank 19, with lead-in portion 27 thereon to facilitate hooking onto a garbage can handle or onto or through a link in chain 29. In the preferred form of the holding means illustrated the hooking portion is about $\frac{1}{3}$ to $\frac{2}{3}$, e.g., $\frac{1}{2}$ the length of the shank portion of the holding means, for better holding onto a handle of a garbage can or other such container for refuse. Chain 29 includes a plurality of interconnected links 31 having openings, such as that at 33 through which hook 25 of holding means 13 may pass. Alternatively, but less desirably, holding means 13 may be otherwise held in position with respect to chain 29, as by holding or clinching onto a link without the hook 25 passing through the link opening. Eye 15 of holding means 13 is held by and to terminal link 35 of chain 29 and the offsetting of the shank portion 19 of holding means 13 allows direct, not angled, transmission of holding force by link 35 to holding means 13. At the other end of chain 29 terminal link 37 is held to terminal eye 39 of elastic or spring means 41 which, as shown, is a helical wire spring 43, integral with holding or hooking means 48, which includes leg or stem portion 45, bend 47, shank 49, U-bend 51, hooking portion 53 and lead-in part 55. Installation of the retainer of FIG. 1 on a garbage can, holding the cover firmly in place thereon, is shown in FIG. 2.

In FIG. 2 second holding means 48 is shown hooked onto handle 57 of garbage can 59 and elastic means 41 is shown in partially extended, tension-producing position, connected to chain 29 which passes through opening 61 in handle 63, which is attached to installed garbage can cover 65. An end portion of chain 29 is passed through handle 67 of garbage can 59 and holding means 13 at the end of the chain is hooked onto link 69 thereof, thereby firmly holding cover 65 to can 59 with the desired holding force being applied thereto and being regulated by spring 41. It will be noted that in the preferred embodiment shown the spring, even when extended, is below the bottom edge of the can cover and is thereby maintained unbent during use, which helps to maintain its usefulness longer.

Use of the present retainer is simple and effective. First, in normal assembly, the garbage can cover is placed in position on the filled garbage can, the second holding means is placed in holding position on a handle of the can and the first holding means and chain of the retainer are passed through the handle opening, which is aligned with the can handles. Then, the first holding means and a portion of the chain are passed through the other handle of the garbage can, the retainer is drawn to the tension desired and the holding means at the end of the chain is joined to a link of the chain, preferably by passing through the opening in said link, so as to hold the desired retainer tension. Preferably, as shown, the chain portion of the retainer first passes through the inside of the garbage can handle and then is drawn outwardly and upwardly to desired holding position with respect to the chin. Of course, instead of assembling in the manner described, it is possible initially to fix the first holding means to the chain at a desired length and about a can handle and then to pass the second holding means, elastic means and some of the chain through the garbage can handle and hook the holding means onto the other handle, while stretching the elastic means.

In use, it is a simple matter for a sanitation man to disconnect the retainer at one of the holding means thereof and pull it through the openings in the can and cover handles so that the cover may be removed. It is unnecessary for him to disconnect the other holding means and in many instances he may desirably reconnect a removed holding means to the handle to which it is normally connected, after removal of the cover, so that the retainer is not separated from the can. In some instances, so as to prevent complete removal of the retainer from the garbage can, radial snap hooks or equivalent safety holding means may be provided at the ends thereof instead of the simpler and less expensive holding means shown. Instead of completely detaching the cover from the can, it may be re-attached, in vertical position, after first removal. The can may be dumped in such position or the sanitation man may re-attach the cover that way so as to indicate that the can has been emptied. The presence of the elastic means in the invented retainers allows for taking up any differences in distances between the handle in the normal cover position and in the side storage positions of the cover. In some cases it will be possible merely to lift the cover, with the retainer in holding position, and then turn the cover to vertical, opened position, without disconnecting either of the holding means. Such may be done by the sanitation man or the householder when he is placing more waste materials in the can and of course, the reverse operation allows ready and secure closing of the cover onto the can.

The present invention has many advantages over prior art devices but the most important of these relate to the ready adaptability of the retainer to different sized garbage cans and covers. Thus, a single retainer may be used with a wide variety of can and cover designs and sizes of cans, such as 10, 15, 20, 25 and 30 gallon (approximately equivalent to 38, 57, 76, 95 and 114 liters) capacity cans, because of the ready adjustability of the retainers. If the extent of adjustability is not sufficient, links may be added or removed comparatively easily. The integral holding and elastic means are readily made, as are the integral holding-eye and elastic-eye means and are simply fastenable to the intervening chain. However, separate spring or elastic means can also be employed and instead of wire eyes, wire springs, wire holding means and wire chain links, these parts may be made of other shapes of stock and of other materals than the preferably steels, which will be described later. Replacement springs or elastic-eye means may be employed to change spring characteristics and cover holding forces, e.g., springs with spring constants from 0.5 kg./cm. to 10 kg./cm. may be interchanged. Preferably the spring constant is in the 1 to 4 kg./cm. range. The parts of the retainer of this invention are comparatively small and all will usually fit through a normal opening in the usual garbage can cover handle, which may be of a size in the range of 1.5 to 3 cm., preferably 2 to 2.5 cm. The wire for the various parts will normally be round and will be of a diameter in the range of 1 mm. to 5 mm., preferably being from 1.5 mm. to 3 mm., with the spring wire generally being smaller than the link wire. The preferred springs are usually about 0.8 to 1.8 cm. in diameter, e.g., 1.3 cm., and 7 to 15 cm. long, e.g., 10 cm. The chain links are usually about 0.4 to 1.5 cm. wide, e.g., 0.6 cm., 1 to 4 cm. long, e.g., 1.5 cm. and the chains are often about 60 to 100 cm. long, e.g., 85 cm. The holding hooks are about 2 to 5 cm. long, e.g., 3 cm. Usually the garbage cans will be of a diameter of 30 to 50 cm., preferably 35 to 45 cm. and will be of a height of about 45 to 70 cm., preferably 50 to 65 cm. Such cans will have handles near the upper part thereof, normally with the topmost portions of the handles in uppermost position being from 5 to 25 cm. from the top, preferably from 7 to 20 cm.

Unlike many other forms of cover retainers, that of the present invention is almost indestructible despite the hard use to which garbage cans and covers are known to be put by sanitation men. When the chains are made of galvanized metal, chrome or nickel plated metal, rubber covered metal, stainless steel or of similar weatherproof material and when the springs are similarly made of corrosion resistant material little damage can be done to the retainers, even when they may be accidentally left in the roadway and run over by automobiles and trucks. Due to the link structure, distortion thereof has little effect on the utility of the device and even flattenings of the springs will not destroy their elasticity. Also, on windy days the can and cover may be retained by the retainer on a post, tree or other fixed position item near the curb so as to prevent rolling into the street, with possible damage being caused to them by passing vehicles. When made of the materials described above the present retainers are completely resistant to destruction by dogs and other animals whereas leather and rubber straps, which have been employed on other cover retainers, may be chewed and cut. Also, the present apparatus is more sanitary and is capable of being washed and sterilized without being harmed, should such treatments be desired. If parts thereof wear out or become permanently damaged so as to be unusable they may be replaced comparatively easily.

The invention is useful with plastic garbage cans with molded-in handles, as well as with steel or other metal cans. The hooking or holding means may be flattened for better holding to such plastic handles of desired but are adequate as illustrated. Although the invention is designed for use with a cover having a central handle it can also be used with covers having no handles. If can handes are not present or are accidentally damaged or removed the present holding means may be adapted to fit small openings cut in the can sides at desired locations.

The materials of construction of the present invention are economical and readily available. For the links and holding means galvanized soft steel wire may be utilized with the links being forged or welded together. Snap links or threaded connecting links may be employed for repairs and can be utilized for terminal links for joining onto the spring and holding means. Harder steel may be utilized, as is known in the art but normally will not be necessary and the additional expense thereof is often unjustifiable. For the elastic means or helical spring, which will usually have about 13½ turns (but may have from 5 to 50) the steel may be a high carbon wire steel, such as AS 8, an oil-tempered steel, such as AS 10 or ASTM A 229-41, a music wire steel, such as AS 5 or ASTM A 228-47, a hard-drawn spring wire steel, such as AS 20 or ASTM A 227-47 or an alloy steel, such as a silico-manganese alloy steel, e.g., AS 70 or SAE 9260. Such steels will have an elastic limit in the 10,000 to 25,000 kg./sq. cm. range, an ultimate strength in the 12,000 to 30,000 kg./sq. cm. range and a modulas of elasticity of about 2,000,000 kg./sq. cm. They will usually be of a Rockwell hardness in the C42-C52 range. While the springs will normally be helical and will be of a spring diameter (not wire diameter) corresponding to the width of the chain link and the width of the holding means other types of springs of other dimensions may also be employed and the holding means and the means for attaching the chain links to the spring may be adapted for fastening onto standard springs having ground ends. As shown in the drawing a preferred elastic means includes the holding means and eye for connection to the chain both integral with the spring and of the same material.

Instead of using metal springs, other elastic means, e.g., organic elastomers, such as natural rubber, Buna rubber, polychloroprene and polyurethane may be employed as well as other acceptable elastomeric materials. Similarly, the chain links and holding means may be made of synthetic organic polymeric materials, such as the engineering plastics and reinforced thermoplastic and thermosetting polymers. For example, among the thermoplastics that may be utilized, preferably reinforced with fiberglass, are the nylons, polycarbonates, styrene-acrylonitrile copolymers, polystyrenes, acrylonitrile-butadiene-styrene copolymers, polypropylenes, polyethylenes, acetals, polysulfones, polyurethanes, phenylene oxide based resins, chorinated polyethers, polyvinyl chlorides and polyesters, and among the thermosetting plastics are the polyesters, epoxies, phenolics, diphthalates, silicones, alkyds, melamines and polyurethanes. Instead of reinforcement with fiberglass, the mentioned polymeric materials may be reinforced with cloths and other types of fibrous or filamentary materials. In all such cases the particular synthetic organic polymeric material and the reinforcement will be chosen for compatibility, sufficient strength in the application intended and weather, moisture and temperature resistance.

Although a preferred form of the invention has been illustrated and described herein it will be evident that to one of skill in the art reading the specification it will suggest the use of various substitutes and equivalents. In some cases the products suggested will not be as effective as those of the preferred embodiment herein described but may have some use, especially in particular applications. For example, instead of utilizing the chain structure of this invention another quickly adjustable and releasable means would be a rubber strap with holes in it at different distances along its length, through which the first holding means might be placed to adjust the tension on the cover. However, the disadvantages of such a substitute have already been referred to earlier. Instead of using a metal spring, as illustrated, other "elastic means", such as an organic elastomer or a piston-cylinder combination in which a gas resists compression and thereby acts as a spring, could be employed. However, such structure is considerably more expensive than that of this invention and is less likely to withstand the harsh treatments to which garbage cans and accessories therefor may be subjected. The polymeric plastic parts mentioned as useful will often be more expensive than those of steel and may not last as long. However, they have the advantage of being rust-free and lighter in weight. The garbage cans and covers utilized, while normally of galvanized sheet iron or steel, may be of the usual synthetic organic plastics generally utilized for such purpose, e.g., polyethylene, polypropylene or other suitable materials, in which case the holding means of this invention will be modified to grip onto the molded-in handles normally employed with such cans.

It is intended to cover within the present invention various modifications and alterations of the presently described preferred embodiments which are within the scope of the broad teachings set forth herein.

What is claimed is:

1. A covered garbage can with a cover being retained firmly in position thereon which comprises a garbage can having a pair of handles on opposite sides thereof, near the top thereof, a cover having a substantially centrally located handle on the top thereof, which cover is in position covering the garbage can, with the handle opening thereof being cut by a vertical plane passing through the middles of the can handles, and a retainer for holding the cover in position on the garbage can, which retainer includes a readily disconnectable first holding means of hook shape, a plurality of connected links connected to said first holding means and forming a chain extending from it, a spring means connected to said chain away from the first holding means, plus a disconnectable second holding means connected to the spring means and adapted for holding onto a handle of the garbage can, said retainer being passed through the cover handle, said second holding means holding onto a garbage can handle, said chain being passed through an opening between the other garbage can handle and the garbage can, and around the other garbage can handle, and the first hook shaped holding means holding to the chain to hold the cover in place with desired force, with the spring means, in normally most extended position, being below the top of the garbage can cover at the side thereof so that the spring is unbent.

2. A covered garbage can according to claim 1 wherein the spring means is a helical spring.

3. A covered garbage can according to claim 2 wherein the second holding means and the spring means of the retainer are of a single piece of wire and the spring means includes loop means, for holding the end of the spring means away from the second holding means to a link of the chain, which loop is integral with the spring and of such wire.

4. A covered garbage can according to claim 2 wherein the helical spring is of wire and is integral with the second holding means, which is of the same wire and is hook shaped.

5. A covered garbage can according to claim 4 wherein the hook shaped second holding means includes an offset shank portion, a bend and an elongated hooking portion which are so positioned that the hook is in alignment with the helical spring.

6. A covered garbage can according to claim 1 wherein the retainer holding means and the chain are of a synthetic organic polymeric material and the spring means is of an organic elastomer.

7. A covered garbage can according to claims 6 wherein the holding means and the chain are of fiberglass reinforced theremoplastic polymer and the spring is of synthetic rubber.

8. A covered garbage can according to claim 3 wherein the hook shaped second holding means includes an offset shank portion, a bend and an elongated hooking portion which are so positioned that the hook is in alignment with the helical spring, the first holding means is hook shaped and the hook shaped first holding means includes an offset shank portion, a bend and an elongated hooking portion which are so positioned that the hook is in alignment with the chain links.

* * * * *